US005915533A

United States Patent [19]

Halle

[11] Patent Number: 5,915,533

[45] Date of Patent: Jun. 29, 1999

[54] INERTIA GOLF HAT

[76] Inventor: Roy Michael Halle, 20 Gilliver Avenue, Vaucluse, Australia, NSW 2030

[21] Appl. No.: 08/700,761

[22] Filed: Jul. 30, 1996

[30] Foreign Application Priority Data

Mar. 26, 1996 [AU] Australia ..... PN8945

[51] Int. Cl.[6] ..... A42B 1/06

[52] U.S. Cl. ..... 2/175.5; 2/425

[58] Field of Search ..... 2/175.5, 425, 175.1; 473/208

[56] References Cited

U.S. PATENT DOCUMENTS

| | | | |
|---|---|---|---|
| 1,352,838 | 9/1920 | Satterfield | 2/175.5 |
| 1,668,023 | 5/1928 | Murphy | 473/211 |
| 2,149,468 | 3/1939 | Santise | 2/175.5 |
| 2,440,878 | 5/1948 | Schneider | 2/10 |
| 2,503,131 | 4/1950 | Rausch | 2/175.2 |
| 2,556,016 | 6/1951 | Turshin | 2/181 |
| 2,725,571 | 12/1955 | Young | 2/175.2 |
| 3,437,339 | 4/1969 | Starck | 473/210 |
| 3,820,780 | 6/1974 | Tarbox | 482/10 |
| 4,096,590 | 6/1978 | Keshock | 2/175.5 |
| 4,098,509 | 7/1978 | Van Krevelen | 473/211 |
| 4,392,830 | 7/1983 | Salzman et al. | 434/258 |
| 4,560,166 | 12/1985 | Emerson | 2/209.13 |
| 4,790,539 | 12/1988 | Clark | 2/425 |
| 4,869,509 | 9/1989 | Lee | 2/209.13 |
| 4,999,851 | 3/1991 | Hall | 2/175.5 |
| 5,199,712 | 4/1993 | Hoyle, Jr. et al. | 2/209.13 |

*Primary Examiner*—Diana L. Oleksa

*Attorney, Agent, or Firm*—Merchant, Gould, Smith, Edell, Welter & Schmidt, P.A.

[57] ABSTRACT

A hat having a brim configured to extend substantially around the head of a wearer, wherein a weight increasing means is provided on the brim to increase a radius of gyration of the hat. Typically, the weight increasing means is provided at, or adjacent to, a periphery of said brim.

21 Claims, 12 Drawing Sheets

TABLE OF CHARACTERISTICS FOR A SAMPLE OF STANDARD, UNMODIFIED HATS

| Hat Type | Parameter and Unit | A | B | C | D | E |
|---|---|---|---|---|---|---|
| Make | - | Niblick | Reebok | Duckster | Town Talk | No Name (Made in China) |
| Style | - | Wide Brim | Shark | Made in USA | Panama | White Bowler's Hat |
| Size | - | All sizes | One size fits all | One Size Fits All | One Size Fits All | One size fits all |
| Brim Width | $W_{brim}$ (m) | 0.085 | 0.083 | 0.078 | 0.077 | 0.080 |
| mass | $m_{sh}$ (kg) | 0.130 | 0.132 | 0.160 | 0.125 | 0.100 |
| circumference | $c_{sh}$ (m) | 1.150 | 1.120 | 1.110 | 1.100 | 1.120 |
| average radius | $r_{sh}$ (m) | 0.183 | 0.178 | 0.177 | 0.175 | 0.178 |
| Thin ring allowance, average radius | $r_{tr}$ (m) | 0.173 | 0.168 | 0.165 | 0.163 | 0.168 |
| moment of inertia (Eq.2) | $I_{sh}$ (kg.m$^2$) | $2.177 \times 10^{-3}$ | $2.57 \times 10^{-3}$ | $2.506 \times 10^{-3}$ | $1.914 \times 10^{-3}$ | $1.584 \times 10^{-3}$ |
| radius of gyration (Eq.5) | $k_{sh}$(metres) | 0.129 | 0.126 | 0.125 | 0.124 | 0.126 |

FIG. 16

DATA FOR SAMPLE MODIFIED HAT A - NIBLICK WIDE BRIM

| | Parameter and Unit | 1 | 2 | 3 | 4 | 5 | 6 | 7 | 8 |
|---|---|---|---|---|---|---|---|---|---|
| mass of "added weight": | $m_{aw}$ and/or $m_{tr}$ (kg) | 0.03 | 0.04 | 0.05 | 0.06 | 0.07 | 0.08 | 0.09 | 0.1 |
| mass of modified hat (total) | $m_{mh}$ (kg) | 0.16 | 0.17 | 0.18 | 0.19 | 0.2 | 0.21 | 0.22 | 0.23 |
| moment of inertia of "thin ring" (Eq. 3) | $I_{tr}$ (kg.m$^2$) | $0.898 \times 10^{-3}$ | $1.197 \times 10^{-3}$ | $1.496 \times 10^{-3}$ | $1.796 \times 10^{-3}$ | $2.095 \times 10^{-3}$ | $2.394 \times 10^{-3}$ | $2.694 \times 10^{-3}$ | $2.993 \times 10^{-3}$ |
| moment of inertia of modified hat (Eq.4) | $I_{mh}$ (kg.m$^2$) | $3.075 \times 10^{-3}$ | $3.374 \times 10^{-3}$ | $3.673 \times 10^{-3}$ | $3.973 \times 10^{-3}$ | $4.272 \times 10^{-3}$ | $4.571 \times 10^{-3}$ | $4.871 \times 10^{-3}$ | $5.17 \times 10^{-3}$ |
| radius of gyration of modified hat (Eq.6) | $k_{mh}$ (metres) | 0.1386 | 0.1409 | 0.1428 | 0.1446 | 0.1462 | 0.1475 | 0.1488 | 0.150 |
| "gyration proportion 1" of modified hat (Eq.7) | GP1 (%) | 75.738% | 76.995% | 78.033% | 79.016% | 79.891% | 80.601% | 81.311% | 81.913% |
| delta, radius of gyration of modified hat (Eq.8) | $\Delta$ k (%) | 7.752% | 9.302% | 10.853% | 12.403% | 13.333% | 14.341% | 15.504% | 16.279% |
| "gyration proportion 2" of modified hat (Eq.9) | GP2 (%) | 92.806% | 91.489% | 90.210% | 88.966% | 88.253% | 87.458% | 86.577% | 86% |
| "(added) weight to radius" ratio of modified hat (Eq.10) | WR ratio (%) | 16.393% | 21.858% | 27.322% | 32.787% | 38.251% | 43.176% | 49.180% | 54.645% |
| "mass proportion" of modified hat (Eq.11) | MP (%) | 23.077% | 30.770% | 38.461% | 46.154% | 53.846% | 61.539% | 69.231% | 76.923% |

FIG. 17

ADDED WEIGHT RECOMMENDATIONS FOR THE NIBLICK WIDE BRIM HAT OF FIG. 16 COLUMN A.

GYRATION PROPORTION 1 (GP1) CHARACTERISTICS (EQUATION 7) FOR THE HAT OF FIG. 18.

CHANGE IN RADIUS OF GYRATION (Δk) CHARACTERISTICS (EQUATION 8) FOR THE HAT OF FIG. 18.

GYRATION PROPORTION 2 (GP2) CHARACTERISTICS (EQUATION 9) FOR THE HAT OF FIG. 18.

WEIGHT TO RADIUS RATIO (WR RATIO) CHARACTERISTICS (EQUATION 10) FOR THE HAT OF FIG. 18.

MASS PROPORTION RATIO (MP RATIO) CHACTERISTICS (EQUATION 11) FOR THE HAT OF FIG. 18.

INERTIA GOLF HAT

FIELD OF THE INVENTION

The present invention relates to hats, and in particular, to hats that can be worn during certain activities, where it is desired to reduce excessive movement of the wearer's head.

BACKGROUND OF THE INVENTION

In many sports, the player's competency is dependent on the amount of control that can be exerted over the body during, for instance, a stroke, hit or other movement of the game.

During a golf swing, it can be difficult for a player to control all body muscles in a precise manner, to produce a consistently straight and accurate flight path of the golf ball.

One aspect of a favourable golf swing is the reduction of excessive head movement. This is because excessive head movement can cause other body parts to be affected, for instance, the hips, shoulders and feet which in turn, can affect the final swing of the golf club or the final impact point of the golf club during the swing.

To help reduce the problem of excessive head movement, it has been known to attach a light device to the player's head. The player can then see a beam of light on the ground which corresponds to his or her head position. The principle is that the player can then consciously control their head, based on the visual feedback of the head position, as represented by a spot of light, to give an opportunity for instant correction. However, it has been seen that these devices can be difficult to use; they can be expensive and usually they interfere with the player's comfort. Additionally, they are often not allowed to be used in competition play.

It is therefore desirable to provide a means for reduction of head movement.

SUMMARY OF THE INVENTION

In accordance with the present invention there is disclosed herein a hat having a brim extending substantially around the head of a wearer, wherein a weight increasing means is provided on a brim of the hat to increase the radius of gyration of the hat. Generally, the weight increasing means is provided at, or adjacent to, a periphery of the brim.

Preferably, the ratio between the radius of gyration and the average radius of the hat, is greater than 75%.

Typically, the weight increasing means comprises one or more lengths of wire. The wire can be selected from the group consisting of solder wire, copper wire and steel wire.

Alternatively, or additionally, the weight increasing means comprises a length of plastics material affixed to the brim.

Typically, a rim of the brim includes a stiffening member and the weight increasing means is positioned substantially adjacent to the stiffening member. Generally, the stiffening member and the weight increasing means are integrally formed. The brim can include a fold at the rim and at least one of the stiffening member and the weight increasing means are arranged within the fold.

Preferably, the weight increasing means increases a mass of the hat by between 20 grams and 120 grams. Most preferably the hat and the weight increasing means have a combined mass of between 120 grams and 300 grams. Advantageously, the combined mass is between 175 grams and 225 grams.

Generally, a radius of gyration of the hat is increased by at least 5% as a result of inclusion of the weight increasing means. Preferably, the radius of gyration of the hat is increased by an amount between 10% and 100%.

Preferably, a proportion between a radius of gyration of the hat, and a radius of the hat is between 70% and 85%.

In another embodiment, the radius of gyration of the hat is increased by 15%.

In a further embodiment, a proportion between the radius of gyration of the hat before the weight increasing means is provided, and the radius of gyration of the hat after the weight increasing means is provided is between 85% and 95%.

Alternatively, a quotient of a mass of the added weight and an average radius of the hat is between 0.1 kg/m and 0.3 kg/m.

In a particular case, a proportion between a mass of the added weight and a mass of the hat before the weight increasing means is provided is between 10% and 30%.

In accordance with another aspect of the present invention there is disclosed a hat having a brim extending substantially around the head of a wearer, the brim incorporating a stiffening member for maintaining stiffness or rigidity near the brim, wherein the stiffening means is increased in mass to cause a sensation of increased inertia, at the wearer's head when rotated.

In accordance with another aspect of the present invention there is disclosed a method of modifying a hat, the hat having a brim extending substantially around a crown into which a wearer's head can be placed, the method comprising the step of (a) adding a weight at or around the periphery. Typically, the method comprises the further steps of (b) adjusting the weight to suit the requirements of wearer, and (c) repeating step (b) as required. Generally, the method comprises the further step of: (d) securing the desired added weight to the periphery.

In accordance with another aspect of the present invention there is disclosed a method of improving the performance of a golf swing, using the method described above.

BRIEF DESCRIPTION OF THE DRAWINGS

A number of embodiments of the present invention will now be described by way of example with reference to the accompanying drawings, wherein:

FIG. 16 is a table of characteristics for a sample of standard, unmodified hats;

FIG. 17 is a table of data for a Niblick wide brim hat as per column A of FIG. 16, modified in accordance with an aspect of the present invention;

DETAILED DESCRIPTION

In hat manufacture, it is a well understood pre-requisite that the hat not be too heavy, and thereby be comfortable for the wearer. As a consequence, the materials from which hats are fabricated are lightweight and not dense. Thus, materials such as straw (raffia), fabrics and felt are widely used. It is also known to provide a a brim stiffening mechanism such as a cable which extends around the periphery of the brim. However, again such stiffening arrangements are always made as light as possible in order that the hat be comfortable.

Figure 1:
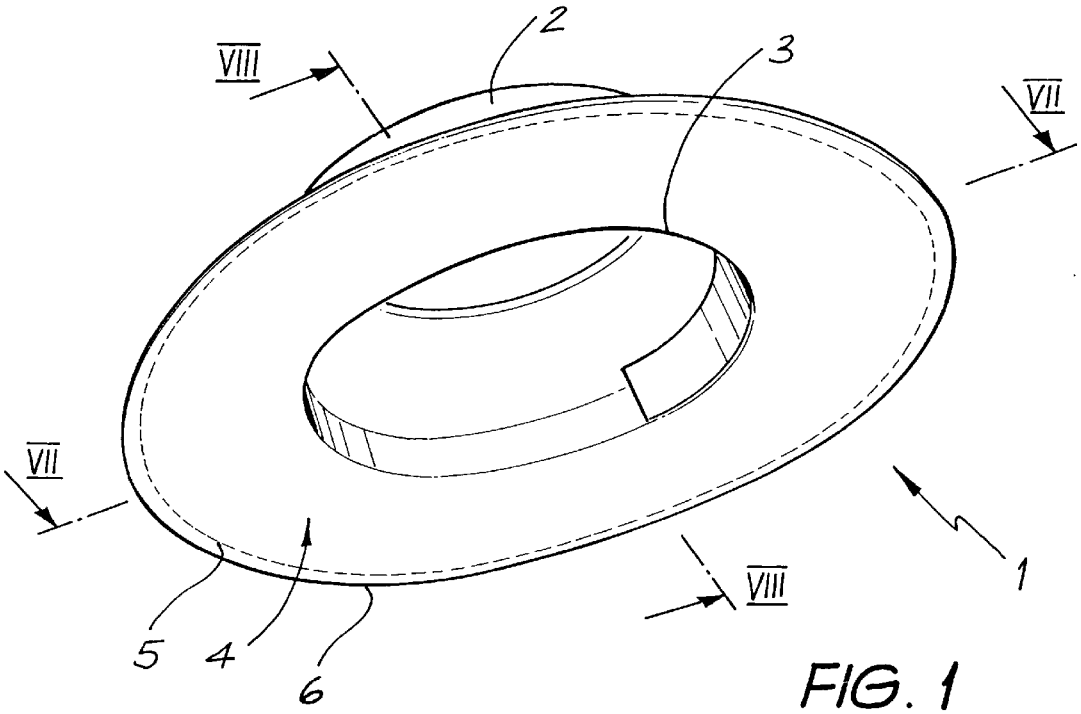
FIG. 1 shows an underside perspective view of a hat in accordance with a first embodiment.

With the foregoing prior art, and hat manufacturing practices in mind, in FIG. 1, a hat 1 is shown comprising a substantially bowl-shaped crown 2, having a oval shaped edge 3. A substantially annular shading brim 4 is extended substantially parallel to a plane formed by the edge 3.

The brim 4 is generally flat, but can also be provided with upward or downward curved features. The brim 4 can be substantially rigid or flexible.

Attached to the underside of the brim 4, is a continuous wire shaped weight 5 arranged at or adjacent to the periphery 6 of the brim 4. In the preferred embodiment, the weight 5 is a length of soldering wire, generally containing 50% lead and 50% tin.

Figure 2:
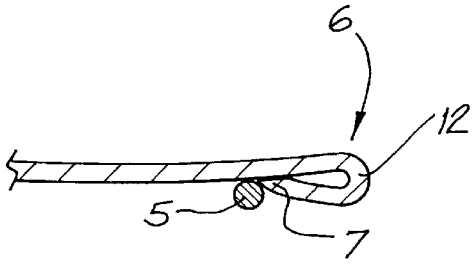
FIG. 2 is an enlarged sectional detail of the rim of the hat of FIG. 1.

FIG. 2 details the periphery 6 of the hat 1, which is created by virtue of a fold 12 of the constructive material of the hat 1. The weight 5, is fixed close to an underside seam line 7 of a fold 12 defining the periphery 6. In the particular embodiment, the weight 5 is stitched in the position illustrated to the brim 4 with cotton thread. Often the fold 12 is provided, not only to provide a neat and durable periphery, but also to assist in a stiffening of the brim 4 as whole.

In embodiments to be described, the added weight complements, or substantially contributes to the stiffening function of the brim 4.

Figure 3:
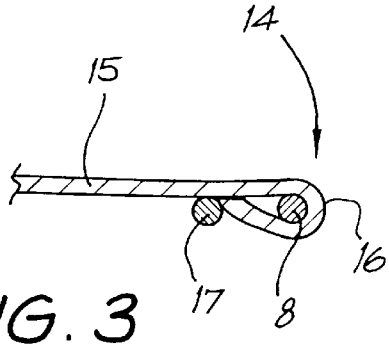
FIG. 3 shows an enlarged sectional detail of a hat rim in accordance with a second embodiment.

Referring to FIG. 3, a periphery 14, of a hat having a brim 15 is shown. The periphery 14 includes a folded rim 16, and an added weight 17, similar to that of FIG. 2. To assist the stiffening of the brim 15, a stiffening member 8, is included within the folded rim 16 to contribute to the stiffening of the brim 15. The stiffening member 8 can be a substantially rigid wire, such as copper or steel of a suitable gauge. Alternatively, the stiffening member can be formed from a substantially rigid plastics material, such as polypropylene or polyvinyl chloride. Further, while the stiffening member 8 is illustrated as having a circular transverse cross section, other shapes can be used such as oval or ribbon shaped beads.

Figure 4:
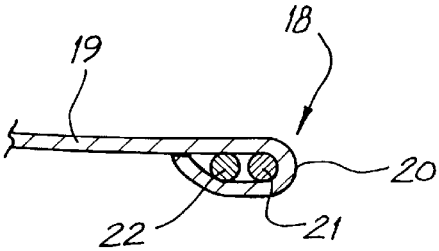
FIG. 4 shows an enlarged sectional detail of a hat rim in accordance with a third embodiment.

Turning now to FIG. 4, a periphery 18 is shown in which an added weight 22 and a stiffening member 21 are each provided within a folded rim 20, of the brim 19. As with the embodiment of FIGS. 1 and 2, the folded rim can be secured by stitching or alternatively by other means such as with an adhesive.

Figure 5:
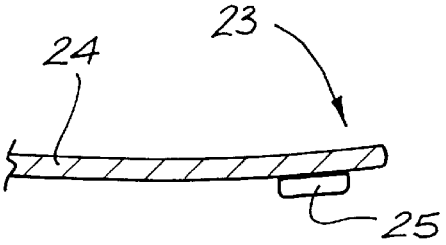
FIG. 5 shows an enlarged sectional detail of a hat rim in accordance with a fourth embodiment.

The embodiment of FIG. 5 shows a periphery 23 of a brim 24 which is provided with a point weight 25, arranged thereabouts. Preferably, a number of point weights 25, are evenly distributed about the circumference of the brim 24 to ensure balance and yet provide a weight distribution relative to the centre of the hat of which the periphery 23 forms a part. For example, 3, 4 or more such weights can be used. Typically, the cumulative mass of the weights 25 is sufficient to contribute to the mass distribution of the hat, whilst each individual weight 25 is not so heavy as to cause an unacceptable distortion of the brim 24.

Figure 6:
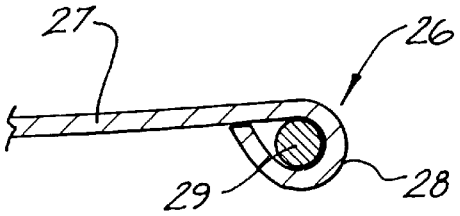
FIG. 6 shows an enlarged sectional detail of a hat rim in accordance with a fifth embodiment.

FIG. 6 shows a periphery 26 of a hat, which incorporates a folded rim and a member 29 enclosed by the fold 28. In this embodiment, the member 29 contributes both to distributing mass from the centre of the hat and also to a stiffening of the brim 27. Thus, in this embodiment, the member 29 represents an integral formation of the weight 22 and member 21 of the embodiment of FIG. 4. For example, the member 29 can be formed by a relatively heavy gauge of copper or steel wire.

Figure 9:
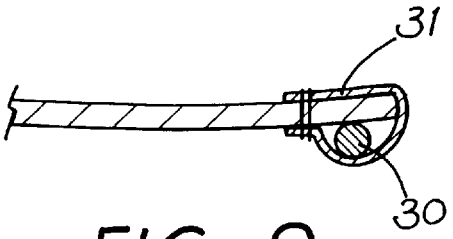
FIG. 9 shows an enlarged sectional detail of a hat rim in accordance with a sixth embodiment.
Figure 10:
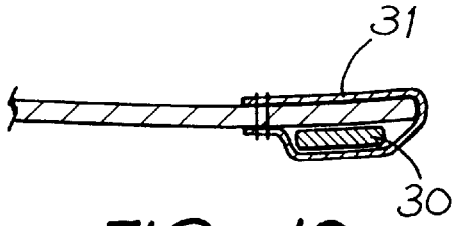
FIG. 10 shows an enlarged sectional detail of a hat rim in accordance with a seventh embodiment.

FIGS. 9 and 10 show an alternative embodiment can be formed by a member 30, not unlike the member 29, which performs the integral function, but which can be manufactured of plastics or similar material and affixed to the periphery of the brim of a hat, such as one that does not incorporate a folded rim. As can be seen, member 30 can be circular in transverse cross-section as shown in FIG. 9 or rectangular in transverse cross-section as shown in FIG. 10. Such an arrangement can be useful with felt pressed hats where folded rims are not typically used, compared with straw hats that are typically provided with a folded rim.

Additionally FIGS. 9 and 10 each show a brim fabric covering 31 which is attached around the periphery of the brim, so as to conceal the member 30.

Figure 11:
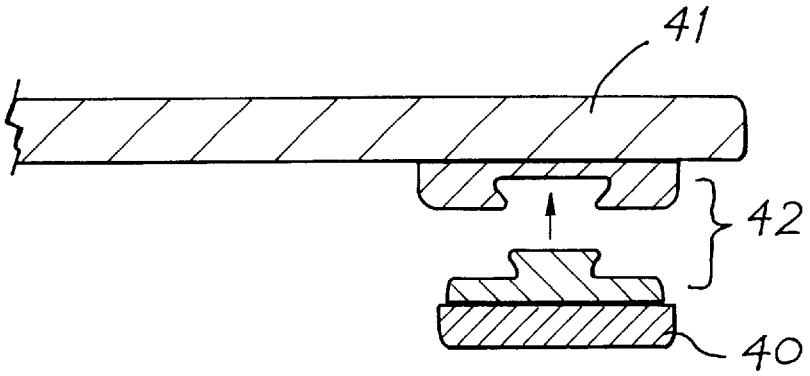
FIG. 11 shows an extra-enlarged sectional detail of a hat rim in accordance with an eight embodiment.

Referring to FIG. 11, an added weight member 40 is attachable to the brim 41, using a push fastener 42, conventionally known as a "press stud".

Figure 12:
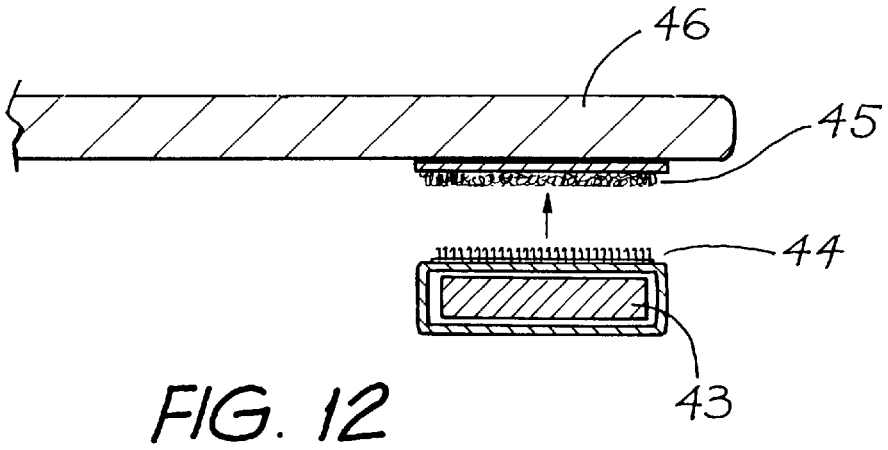
FIG. 12 shows an extra-enlarged sectional detail of a hat rim in accordance with a ninth embodiment.

Yet another variation of attaching a weighted member 43 to the brim 46 is shown in FIG. 12. Member 43 is provided with a hook fabric 44 on one plane and a loop fabric 45 is provided on the hat, corresponding to the hook fabric 44, to make contact. The hook and loop fabric 44 and 45 respectively is known under the trade name of "Velcro".

Experiments conducted by the present inventor using a hat configured in accordance with the first embodiment have demonstrated an increase in head stability that has been found to be advantageous when playing golf, and in particular when swinging a golf club.

The principle understood by the inventor, to be that upon which this advantage is realised, derives from the following relationship:

$$\alpha = \frac{T}{I} \quad \text{(Equation 1)}$$

where =the angular acceleration (rad.s$^{-2}$) of the golfer's head imposed on the golfer's hat as the head is moved.

T=the torque of the golfer's head (Nm) imposed on the hat, and

I=the moment of inertia (kg.m$^2$) of the hat.

Therefore, an increase in I will result in a reduction in , thus helping to keep the golfer's head steady during the golf swing.

The following calculations demonstrate how the effect on various physical parameters of the hat can be defined, according to the described embodiments.

Figure 7:
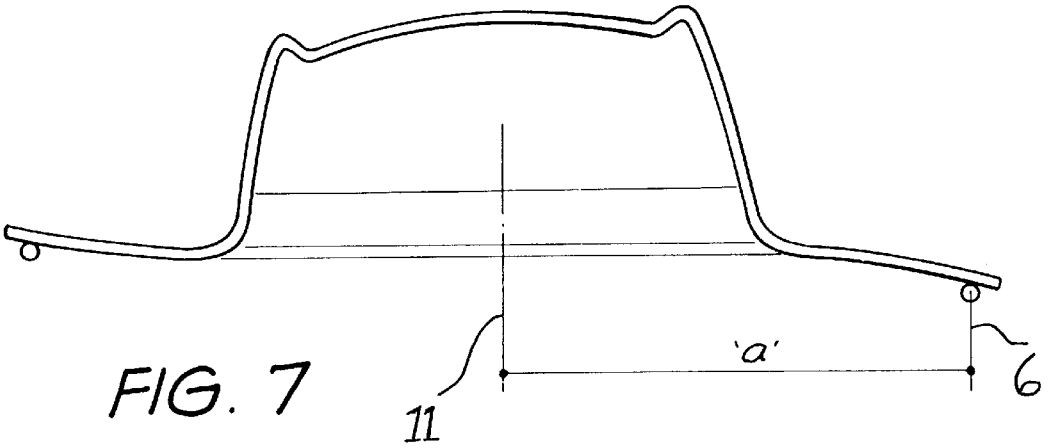
FIG. 7 shows a sectional view along the line VII—VII of FIG. 1.
Figure 8:
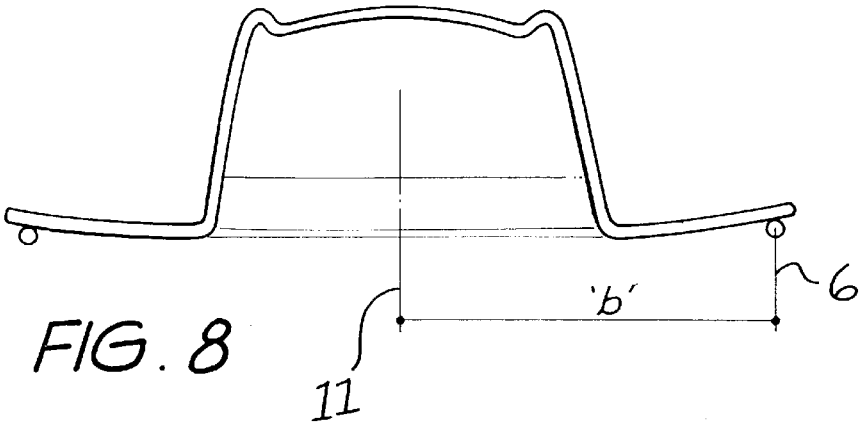
FIG. 8 shows a sectional view along the line VIII—VIII of FIG. 1.

Referring now to FIG. 7, dimension "a" is shown, corresponding to the hat's radius in the plane where the maximum radius is seen. The radius "a" is measured horizontally from the hat centre 11, to the hat periphery 6. FIG. 8 shows dimension "b", corresponding to the hat's radius in the vertical plane where the minimum radius is seen. The radius "b" is also measured from the hat centre 11, to the hat periphery 6.

For another embodiment, the equivalent radius "a" or "b" is common to all vertical planes. In other words, the hat, when viewed from the top or bottom is substantially annular.

For practical purposes, the average is taken for dimensions "a" and "b", as shown in FIGS. 7 and 8 respectively, to provide a nominal radius of the hat. Of course, in the case of a circular hat, the average calculation is not applicable. Alternatively, a substantially universal method of determining the average radius of a hat is measure the circumference of the hat, and divide that value by 2 π. Such an average radius will apply for circular brimmed hats, and also provides a workable approximation for shaped hats that have an oval circumference (eg. "cowboy" style hats).

A flat disc or cylinder has a "moment of inertia" I, according to the formula:

$$I_{HAT} \text{ or } I_{sh} = \frac{1}{2} m_{sh} (r_{av})^2 \quad \text{(Equation 2)}$$

where $m_{sh}$=mass of the disc or cylinder (kg), and $r_{av}$=average radius of the disc or cylinder (m).

For practical purposes, Equation 2 is appropriate for calculation of the "moment of inertia" for the hat without the added weight. This is justified on the fact that the shape of the hat, is generally comprised only of flat, circular, or cylindrical shapes.

A thin ring, however, has a "moment of inertia" I, according to the formula:

$$I_{RING} \text{ or } I_{tr} = m_{tr} (r)^2 \quad \text{(Equation 3)}$$

where $m_{tr}$=mass of the thin ring (kg), and $r_{tr}$=radius of the thin ring (m).

For practical purposes, Equation 3 is appropriate for calculation of the "moment of inertia" for the weight that is added to the hat.

The total "moment of inertia" for the hat, including the added weight, can then be determined by summation of Equations 2 and 3:

$$I_{TOTAL} = I_{HAT} + I_{RING} = \tfrac{1}{2} . m_{HAT} . r^2_{HAT} + m_{RING} . r^2_{RING} \quad \text{(Equation 4)}$$

Next, the "radius of gyration" is considered. This parameter refers to the distance from the centre of rotation of a rotating body, to the point where the mass can be considered to be concentrated. Note that this parameter is different to the "centre of mass".

The relevant formulas for radius of gyration, (k) include:

$$k_{sh} = \sqrt{\frac{I_{sh}}{m_{sh}}} \quad \text{(Equation 5)}$$

where $k_{sh}$=the radius of gyration of a standard hat (m), $I_{sh}$=total moment of inertia (kg m$^2$) of a standard hat, and $m_{sh}$=total mass (kg) of a standard hat.

$$k_{mh} = \sqrt{\frac{I_{mh}}{m_{mh}}} \quad \text{(Equation 6)}$$

where $k_{mh}$=the radius of gyration (m) of a modified hat, $I_{mh}$=total moment of inertia (kg.m$^2$) of a modified hat, and $m_{mh}$=total mass (kg) of a modified hat.

Figure 18:
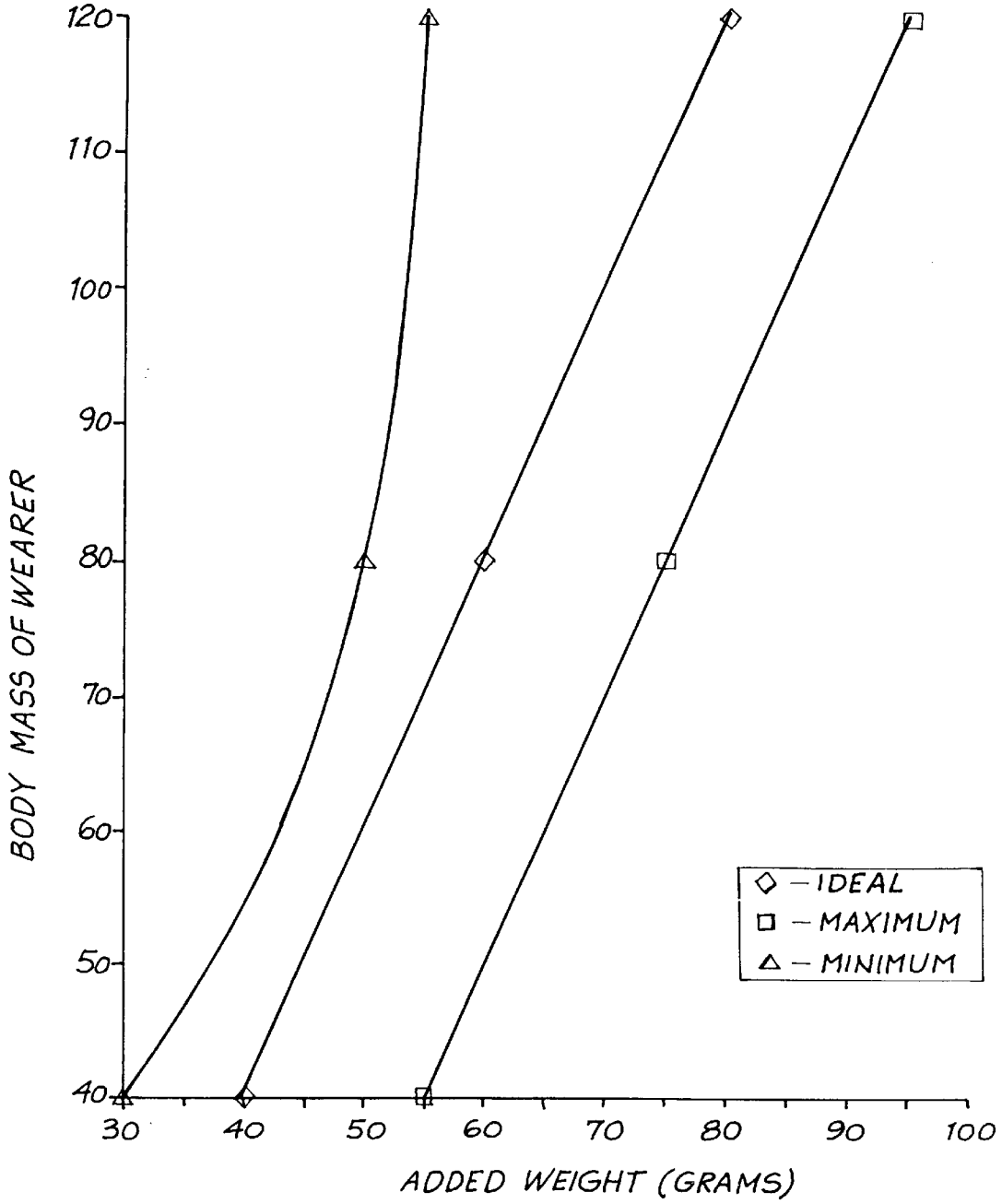
FIG. 18 is a graph of added weight recommendations to the Niblick wide brim hat, as per column A of FIG. 16, and a wearer's body mass, in accordance with an aspect of the invention.

The present inventor has conducted experiments to assess the applicability of the foregoing. The results of one specific experiment is shown in FIG. 18.

It is concluded from the specific experiments that the premise as indicated for Equation 1 is valid and that the practical design principles for embodiments can be formulated from various physical parameters proportional to I, m and r.

Figure 19:
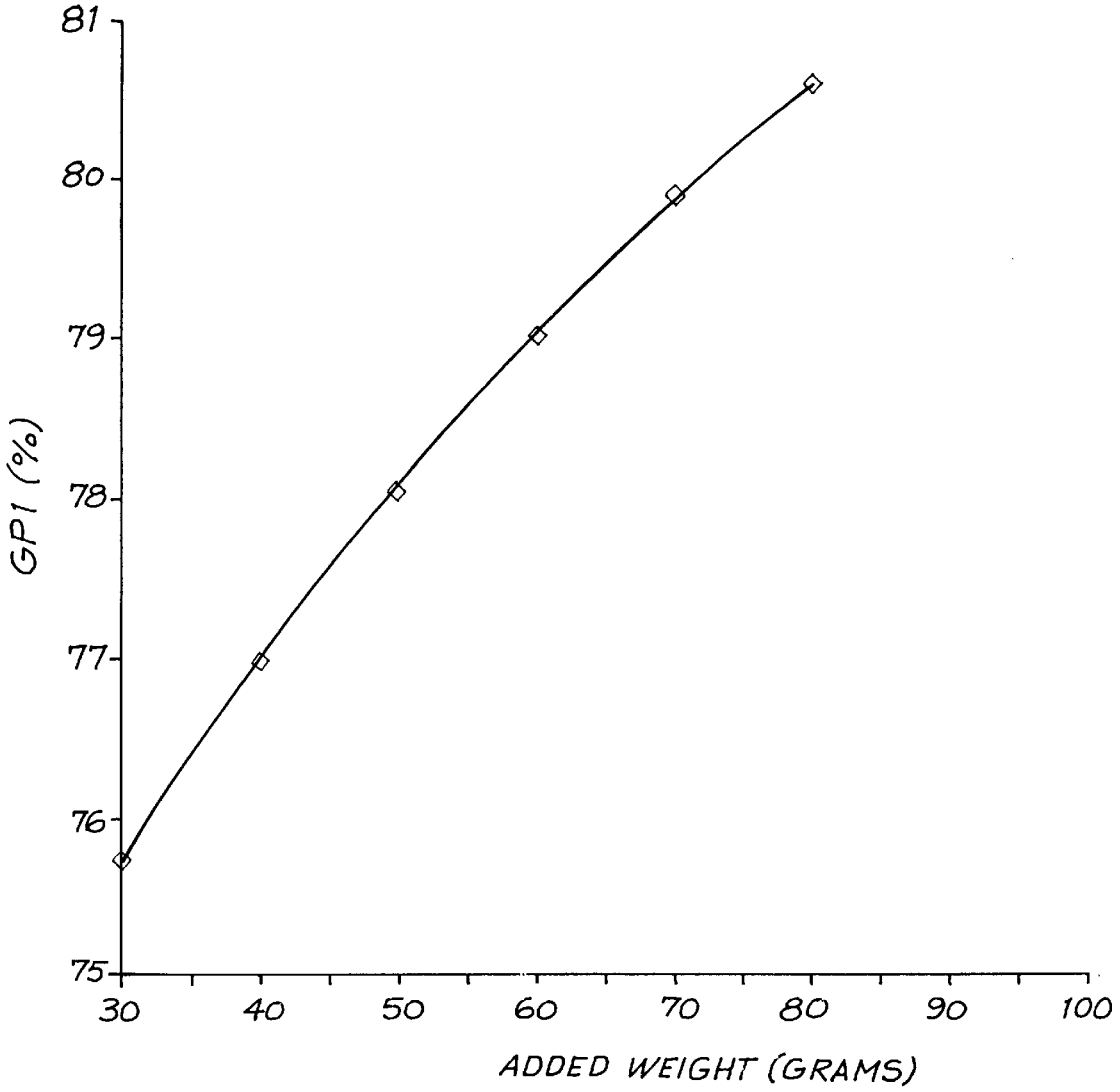
FIG. 19 is a graph of Gyration Proportion 1 (GP1) characteristics, for the hat of FIG. 18, in accordance with an aspect of the present invention.

GP1 (Gyration Proportion, Method 1) is the ratio between the radius of a standard hat (without the added weight) to the radius of gyration of a modified hat (with the added weight). The GP1 ratio is typically between 70% to 85% and can depend on the physical body type (i.e. small, medium or large) of the wearer. This characteristic is shown in FIG. 19 for the hat of FIG. 18.

$$GP1 = (k_{mh}/r_{sh}) \times 100 \quad \text{(Equation 7)}$$

where $r_{sh}$=the average radius of a standard hat (meters), and $k_{mh}$=the radius of gyration of a modified hat (meters).

Figure 20:
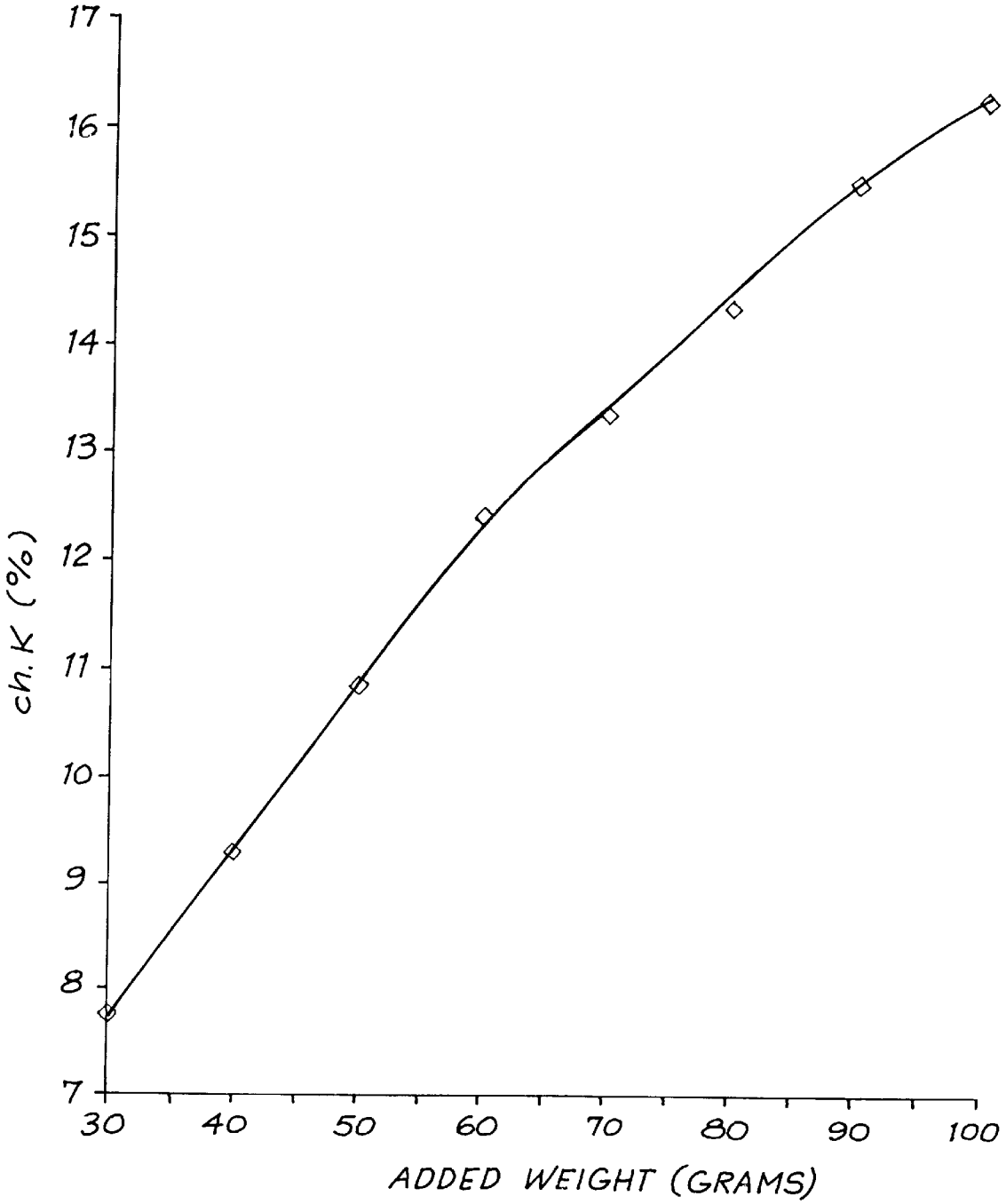
FIG. 20 is a graph of the Change in Radius of Gyration characteristics (Δk) for the hat of FIG. 18, in accordance with an aspect of the present invention.

The Δk (Change in Radius of Gyration) is the change in the radius of gyration, expressed as a percentage, of a modified hat (with the added weight), with the radius of gyration of the same hat without the added weight. The Δk ratio is typically up to 15% and can depend on the physical body type of the wearer. This characteristic is shown in FIG. 20, for the hat of FIG. 18.

$$\Delta k = ((k_{mh} - k_{sh})/k_{sh}) \times 100 \quad \text{(Equation 8)}$$

where $k_{sh}$=the radius of gyration of a standard hat (meters), and $k_{mh}$=the radius of gyration of a modified hat (meters).

Figure 21:
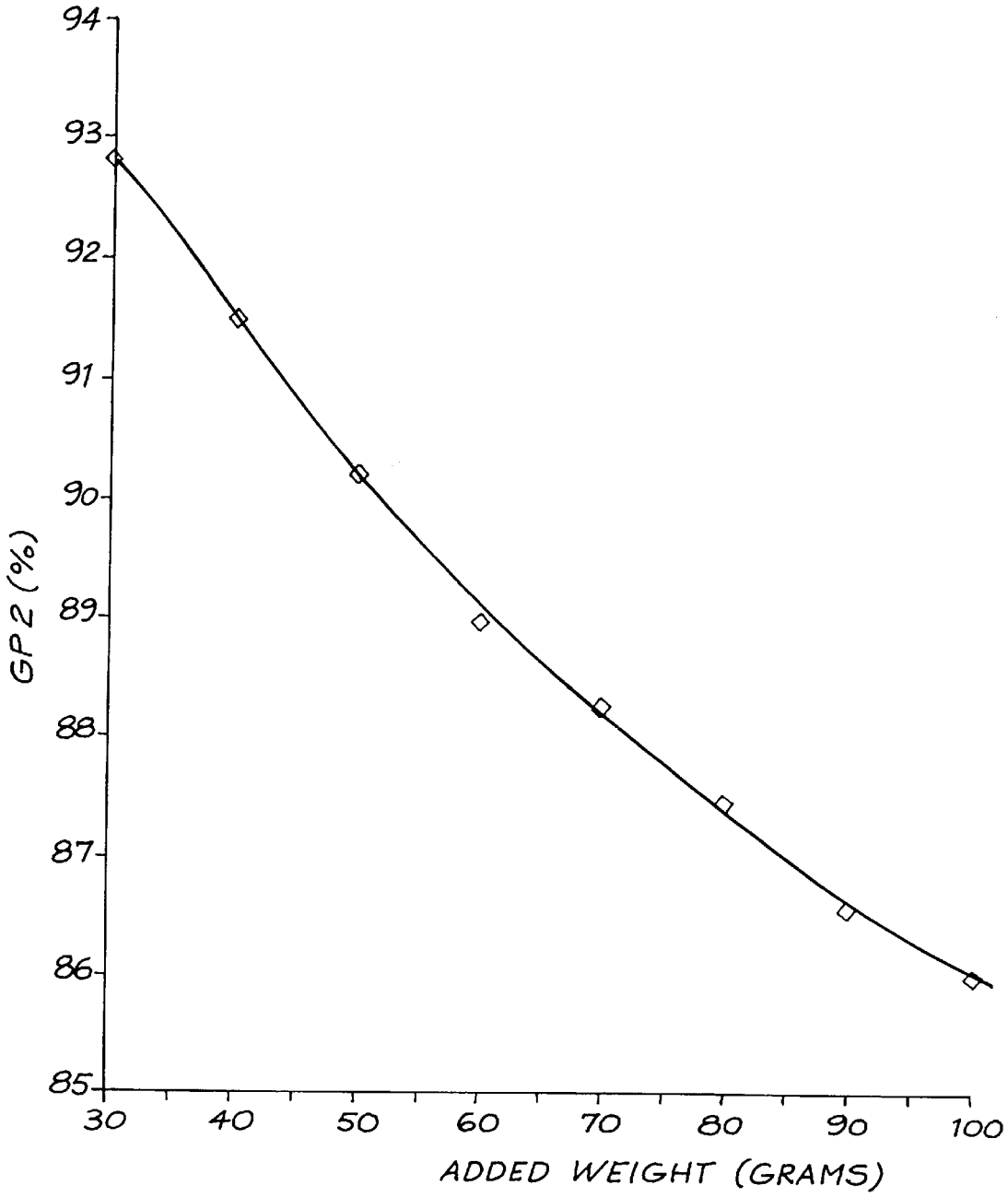
FIG. 21 is a graph of Gyration Proportion 2 (GP2) characteristics for the hat of FIG. 18, in accordance with an aspect of the present invention.

The GP2 (Gyration Proportion, Method 2) is the ratio between the radius of gyration of a standard hat (without the added weight) to the radius of gyration of a modified hat (with the added weight). The GP2 ratio is typically between 85% to 95% and can depend on the physical body type of the wearer. This characteristic is shown in FIG. 21 for the hat of FIG. 18.

$$GP2=(k_{sh}/k_{mh})\times 100 \quad \text{(Equation 9)}$$

where $k_{sh}$=the radius of gyration of a standard hat (meters), and $k_{mh}$=the radius of gyration of a modified hat (meters).

The WR ratio is the ratio between the actual added weight with the radius of the brim, such that:

$$WR=(m_{aw}/r_{sh})\times 100 \quad \text{(Equation 10)}$$

where $m_{aw}$=the mass of the added weight (kg), and $r_{sh}$=the average radius of the standard hat (meters).

Figure 22:
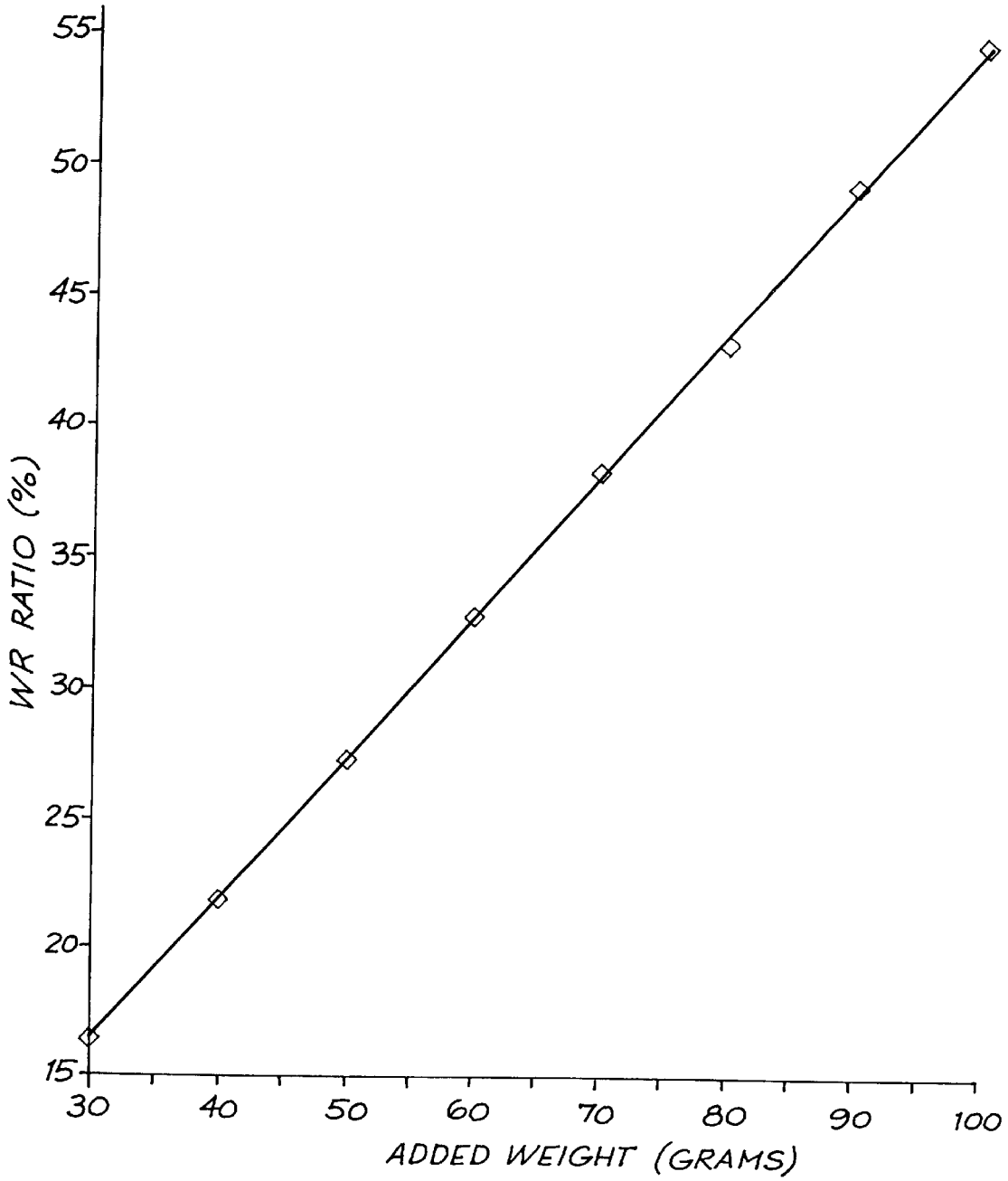
FIG. 22 is a graph of Weight to Radius Ratio (WR) characteristics of the hat of FIG. 18, in accordance with an aspect of the present invention.

The WR ratio (expressed as a percentage) is typically between 10% and 30% and can depend on the physical body type of the wearer. This characteristic is shown in FIG. 22 for the hat of FIG. 18.

The MP ratio is the ratio between the mass of the added weights and the mass of the standard hat.

$$MP=(m_{tr}/m_{sh})\times 100 \quad \text{(Equation 11)}$$

where $m_{tr}$=mass of the thin ring (kg), and $m_{sh}$=mass of the standard hat (kg)

Figure 23:
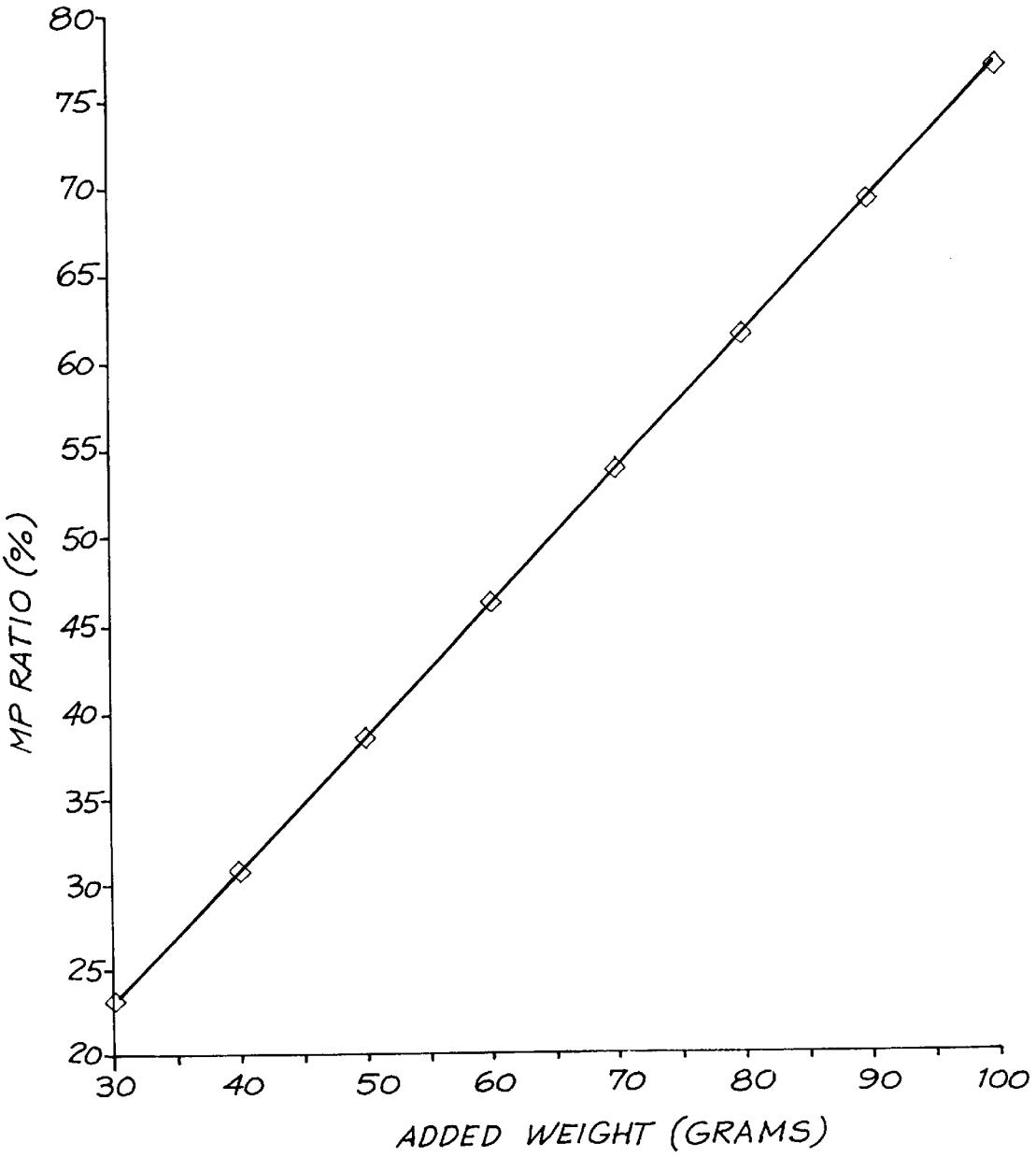
FIG. 23 is a graph of added weight to standard hat weight ratio, or Mass Proportion (MP) radio for the hat of FIG. 18, in accordance with an aspect of the present invention.

The MP ratio (expressed as a percentage) is typically between 10% and 30% and can depend on the physical body type of the wearer. This characteristic is shown in FIG. 23 for the hat of FIG. 18.

The weight 5 can be solder wire with different proportions of tin and lead. It need not necessarily be in the form of a single strand, rather it could be flat or comprising a bunch of smaller strands.

The hat need not necessarily be conventional and the modifications according to the described embodiments can be applied to non-conventional hats. For example those hats which are collapsible, by virtue of the outer edge being a flexible wire which, in the open configuration supports a soft fabric, to thus form the hat.

Further, the added weight need not be distributed evenly about the hat. For example, oval shaped brims (eg. "cowboy" hats) can have a greater added weight concentration at or near the smallest brim radius, and a smaller added weight concentration at or near the largest brim radius, thus approximating the moment of inertia of a circular ring mentioned above.

Figure 13:
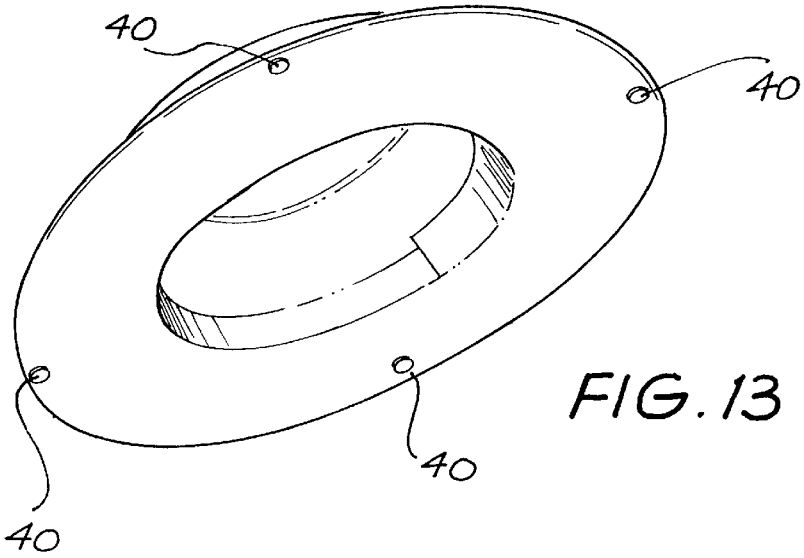
FIG. 13 shows an underside perspective view of a hat in accordance with a tenth embodiment.

As shown in FIG. 13, the continuous wire shaped weight 5 of FIG. 1 is replaced with individual point weights 40, each attached near the periphery of the brim. This particular distribution of weight has a "moment of inertia" I, according to the formula:

$$I=\Sigma(Mr^2) \quad \text{(Equation 12)}$$

where m=mass of each point weight (kg)

r=average radius of each point weight from the centre of the hat (m).

For practical purposes, Equation 12 is appropriate for calculation of the "moment of inertia" and then radius of gyration for the group of point weights 40 that are added to the hat.

Figure 14:
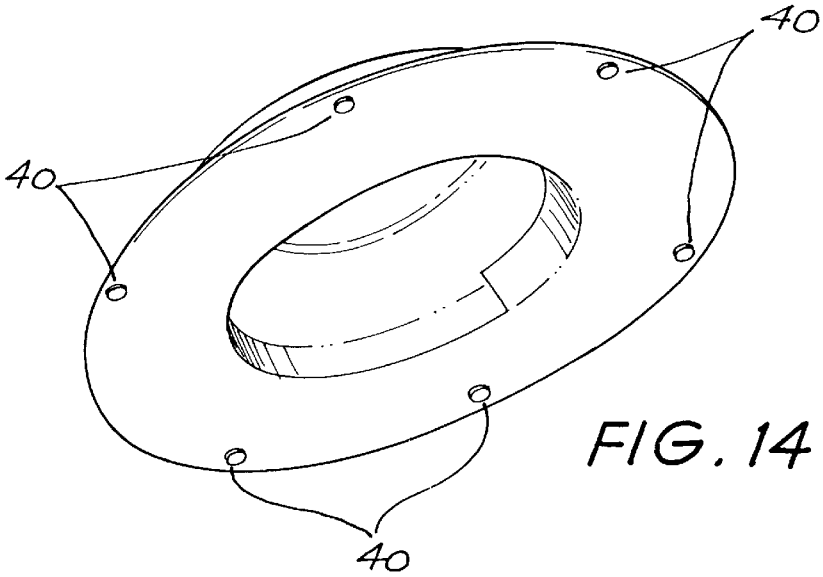
FIG. 14 shows an underside perspective view of a hat in accordance with an eleventh embodiment.
Figure 15:
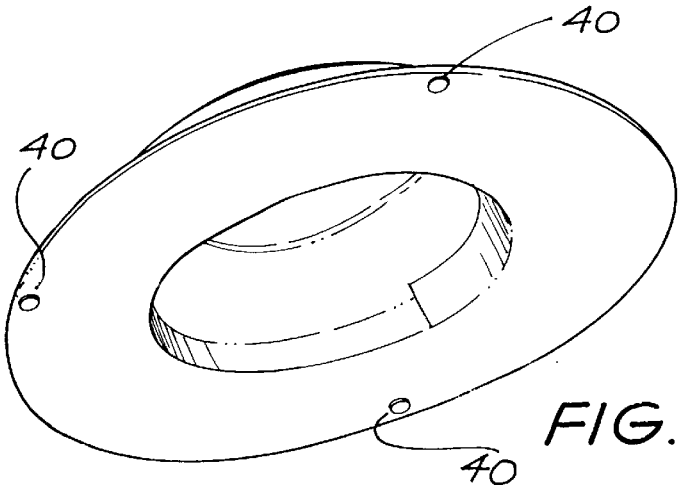
FIG. 15 shows an underside perspective view of a hat in accordance with a twelfth embodiment.

FIGS. 14 and 15 show yet other variations of the distribution of point weights 40 as shown in FIG. 13.

Referring to FIG. 16, a sample of hats that the present inventor has experimented with and modified in accordance with the described embodiments are indicated. Various calculations and characteristics have been shown, which will be shown to be relevant in accordance with the formulas as disclosed herein.

FIG. 18 shows the results of the inventor's experiments for a single specific hat being the Niblick wide brim hat as per column 1 of FIG. 17. Accordingly, FIG. 19 to FIG. 23 indicate the corresponding calculated characteristics which can be applied to other hats, in order to determine the corresponding mass or moment of inertia required of the added weight.

Further, it will be appreciated that increasing the weight of the brim of the hat will contribute to retaining the hat on the head of the wearer, particularly under windy conditions.

Numerous modifications and alterations, as would be apparent to one skilled in the art, can be made to the described embodiments without departing from the spirit and scope of the present invention. All such modifications and alterations are to be considered within the scope of the present invention, embodiments of which have been hereinbefore described. For example, the hat substrate can be manufactured of any appropriate material, such as straw, cotton, felt, fur, or synthetic materials.

I claim:

1. A golf hat having a brim configured to extend substantially around the head of a wearer, wherein a radius of gyration of said hat is in the range of 138 mm to 149 mm.

2. The hat as claimed in claim 1, further comprising weight increasing means provided at, or adjacent to, a periphery of said brim, and contributing to said radius of gyration.

3. The hat as claimed in claim 2, wherein said weight increasing means comprises at least one length of wire.

4. The hat as claimed in claim 3, wherein said wire is selected from the group consisting of solder wire, copper wire and steel wire.

5. A golf hat comprising an annular brim configured to extend substantially around the head of a wearer, and a weight increasing means is associated with said brim to increase a radius of gyration of said hat, wherein a ratio between said radius of gyration and an average radius of said hat, is greater than 75%.

6. The hat as claimed in claim 5, wherein said weight increasing means comprises at least one length of wire.

7. The hat as claimed in claim 6, wherein said wire is selected from the group consisting of solder wire, copper wire and steel wire.

8. A golf hat comprising a brim configured to extend substantially around the head of a wearer, and a weight increasing means associated with a periphery of said brim, wherein said weight increasing means increases a mass of said hat by between 20 grams and 120 grams.

9. The hat as claimed in claim 8, wherein said hat and said weight increasing means have a combined mass of between 120 grams and 300 grams.

10. The hat as claimed in claim 9, wherein said combined mass is between 175 grams and 225 grams.

11. A golf hat comprising a brim configured to extend substantially around the head of a wearer, and a weight increasing means provided at, or adjacent to, a periphery of said brim to increase a radius of gyration of said hat, wherein the radius of gyration of said hat is increased by at least 5% as a result of inclusion of said weight increasing means.

12. A golf hat comprising a brim configured to extend substantially around the head of a wearer, and a weight increasing means is provided at, or adjacent to, a periphery of said brim to increase a radius of gyration of said hat by an amount between 10% and 100% compared with said hat absent said weight increasing means.

13. A golf hat comprising a brim configured to extend substantially around the head of a wearer, and a weight increasing means associated with a periphery of said brim to increase a radius of gyration of said hat, wherein a proportion between a radius of gyration of the hat, and a radius of said hat is between 70% and 85%.

14. A golf hat comprising a brim configured to extend substantially around the head of a wearer, and for which a radius of gyration exists, said hat further comprising a weight increasing means provided at, or adjacent to, a periphery of said brim to increase said radius of gyration of said hat by about 15%.

15. A golf hat having a brim configured to extend substantially around the head of a wearer, and a weight increasing means associated with said brim to increase said radius of gyration of said hat, wherein a proportion between the radius of gyration of the hat before said weight increasing means is provided, and the radius of gyration of the hat after the weight increasing means is provided is between 85% and 95%.

16. A golf hat having a brim configured to extend substantially around the head of a wearer, and a weight increasing means provided at, or adjacent to, a periphery of said brim to increase a radius of gyration of said hat, wherein a quotient of a mass of said weight increasing means and an average radius of said hat is between 0.1 kg/m and 0.3 kg/m.

17. A golf hat having a brim configured to extend substantially around the head of a wearer, and a weight increasing means associated with said brim to increase a radius of gyration of said hat, wherein a proportion between a mass of said weight increasing means and a mass of the hat before said weight increasing means is provided is between 10% and 30%.

18. A method of influencing the manual enactment of a golf swing, said method comprising the steps of:

(a) providing a hat with a brim configured to extend substantially around a crown in which a person's head can be placed, said hat having a radius of gyration within the range of 138 mm to 149 mm; and (b) wearing the hat to perform a golf swing.

19. A method of influencing the manual enactment of a golf swing, said method comprising the steps of:

(a) providing a hat with a brim configured to extend substantially around a crown in which a person's head can be placed, said hat having an existing associated radius of gyration;

(b) increasing said radius of gyration by providing a weight at or around a periphery of said hat to increase said existing radius of gyration of said hat by at least 5%; and (c) wearing the hat to perform a full golf swing.

20. A method of manufacturing a golf hat, said method comprising the steps of:

(a) empirically determining a range of average radius of gyration values attributable to a hat which optimizes the performance of a golfer's swing; and (b) adjusting a structure of said hat to fall within said range.

21. A method as claimed in claim 20, wherein said adjusting step comprises providing a weight at or around a periphery of said hat.

* * * * *

UNITED STATES PATENT AND TRADEMARK OFFICE

CERTIFICATE OF CORRECTION

PATENT NO. : 5,915,533 PAGE 1 of 2

DATED : JUNE 29, 1999

INVENTOR(S) : HALLE

It is certified that error appears in the above-identified patent and that said Letters Patent is hereby corrected as shown below:

Title page, [56] References Cited, U.S. Patent Documents: insert the following in appropriate order:

| | | |
|---|---|---|
| — 1,558,142 | 10/1925 | Brenner |
| 1,568,626 | 1/1926 | Robson |
| 1,636,889 | 7/1927 | Wittcoff |
| 1,692,740 | 11/1928 | Huber |
| 1,980,101 | 11/1934 | Schneider |
| 2,879,518 | 3/1959 | Welton |
| 3,109,654 | 11/1963 | Comitz |
| 3,178,187 | 4/1965 | Cardwell |
| 3,510,881 | 5/1970 | Deutsch |
| 3,729,200 | 4/1973 | Hines et al. |
| 4,502,035 | 2/1985 | Obenauf et al.— |
| 4,854,584 | 8/8/89 | Soucy- and -4936584 6/26/90 Ewald et al. |

Title page, [56] References Cited, Foreign Patent Documents: insert —Foreign Patent Documents:

| | | |
|---|---|---|
| AU-B-14324/88 | 6/1988 | Australia |
| AU-B-64904/90 | 10/1991 | Australia — |

UNITED STATES PATENT AND TRADEMARK OFFICE

CERTIFICATE OF CORRECTION

PATENT NO. : 5,915,533 PAGE 2 of 2

DATED : JUNE 29, 1999

INVENTOR(S) : HALLE

It is certified that error appears in the above-identified patent and that said Letters Patent is hereby corrected as shown below:

Col. 5, line 14: insert —α— after "where"

Col. 5, line 19: insert —α— after "reduction in"

Col. 5, line 64: "$(r)^{2}$" should read —$(r_{tr})^2$—

Col. 7, line 58: "$(Mr^2)$" should read —$(mr^2)$—

Signed and Sealed this

Twenty-eighth Day of November, 2000

*Attest:*

Q. TODD DICKINSON

*Attesting Officer*

*Director of Patents and Trademarks*